United States Patent [19]

Leonetti et al.

[11] Patent Number: 4,805,790

[45] Date of Patent: Feb. 21, 1989

[54] FLIP TOP CAP

[76] Inventors: Frank A. Leonetti; Richard L. Leonetti, both of P.O. Box 2415, Santa Cruz, Calif. 95063

[21] Appl. No.: 94,219

[22] Filed: Sep. 8, 1987

[51] Int. Cl.[4] ..... B65D 51/04

[52] U.S. Cl. ..... 215/235

[58] Field of Search ..... 215/235, 237; 220/335, 220/339; 222/498, 517, 556

[56] References Cited

U.S. PATENT DOCUMENTS

| | | | |
|---|---|---|---|
| 1,242,742 | 10/1917 | Townsend . | |
| 1,815,319 | 7/1931 | Lawrence | 221/60 |
| 1,842,570 | 1/1932 | Richter . | |
| 1,850,606 | 3/1932 | Smith | 221/60 |
| 2,037,172 | 4/1936 | Leffert | 221/60 |
| 2,050,809 | 8/1936 | Ruetz | 221/60 |
| 2,111,186 | 3/1938 | Jenks | 221/60 |
| 2,263,783 | 11/1941 | Langenstein . | |
| 2,411,058 | 11/1946 | Rockwell . | |
| 2,661,861 | 12/1953 | Oldenburg . | |
| 2,696,935 | 11/1954 | Obeck | 222/498 |
| 2,708,535 | 5/1955 | Dettelbach | 222/498 |
| 3,199,748 | 8/1965 | Bross | 222/517 |
| 3,289,877 | 12/1966 | Wolf . | |
| 3,845,872 | 11/1974 | Towns . | |
| 4,172,540 | 10/1979 | Erichson et al. | 222/517 |
| 4,234,103 | 11/1980 | Strobl et al. | 222/83.5 |
| 4,236,653 | 12/1980 | Gach | 222/153 |
| 4,358,032 | 11/1982 | Libit | 222/498 |
| 4,371,095 | 8/1983 | Montgomery et al. | 222/153 |
| 4,386,714 | 6/1983 | Roberto et al. | 215/235 X |
| 4,414,705 | 11/1983 | Ostrowsky | 220/339 X |
| 4,513,888 | 1/1985 | Curry | 222/153 |
| 4,558,806 | 12/1985 | Shabram et al. | 222/556 |
| 4,595,111 | 6/1986 | Gould et al. | 215/303 |
| 4,601,413 | 7/1986 | Krawagna | 222/498 |
| 4,666,068 | 5/1987 | Bush | 222/546 |

*Primary Examiner*—Donald F. Norton

*Attorney, Agent, or Firm*—Townsend and Townsend

[57] ABSTRACT

A flip-top-type cap for containers which dispense products such as shampoo, lotion, liquid soap and condiments is disclosed. The cap is comprised of (a) a base portion containing an orifice, and (b) a top portion mounted to the base portion at one side by a hinge connection, with a stopper in the top portion to mate with the orifice; and an operating member mounted to the such that one end of the member is exposed at the same side of the closure as the hinge connection. Lateral pressure on the member forces it against a contact surface in the cap, which in turn forces the top and bottom portions apart, thereby disengaging the stopper from the orifice. Disengagement of the stopper from the orifice, swinging open of the cap, and closing the cap to reengage the stopper and orifice are all accomplished by a single thumb or finger of one hand, while that same hand alone holds the container to which the cap is secured.

24 Claims, 2 Drawing Sheets

FLIP TOP CAP

BACKGROUND OF THE INVENTION

1. Field of the Invention

This invention relates to plastic caps for dispensers, and especially to flip-top-type plastic caps for containers dispensing products such as shampoo, lotion, liquid soap, and condiments.

2. Description of the Prior Art

A large variety of flip-top-type plastic caps are known. Such caps generally consist of a base with a pivoting cover, the base having an axial dispensing outlet, and the cover including a closure to stopper the outlet.

To date, no known design permits full operation of the cap with a single thumb or finger. Such operation would enable one to open the cap and dispense the container contents using only one hand, thereby ensuring sanitary and efficient handling of the dispenser.

Cap designs of the prior art require more than one thumb or finger to operate. Since flip top caps tend to accumulate material from the container along the dispensing path, the placement of the thumb or fingers in the region of the dispensing path is both inconvenient and unsanitary. See for example Bush, U.S. Pat. No. 4,666,068, May 19, 1987.

In some cap designs, the closure mechanism is operated by projections which are engageable by a thumb or finger. These are efficient and sanitary in some cases, but cannot be manufactured economically, and the containers are difficult to stack and to maintain closed during shipping, handling and storage. See for example Jenks, U.S. Pat. No. 2,111,186, Mar. 15, 1938.

The prior art cap designs are most easily operated by the use of more than one thumb or finger. In some cases, two hands are needed to open the cap and dispense the product, a serious problem when only one hand is available. This problem is especially evident in child resistant designs, for example Gach, U.S. Pat. No. 4,236,653, Dec. 2, 1980, where safety closures are important. There is therefore a distinct need for an efficiently designed flip-top-type cap which can be opened and closed with one finger and fully operated with one hand.

SUMMARY OF THE INVENTION

A dispensing cap has now been developed which comprises (a) a base portion containing an orifice, and (b) a top portion mounted to the base portion at one side by a hinge connection, with a stopper in the top portion to mate with the orifice; and an operating member mounted to the closure such that one end of the member is exposed at the same side of the closure as the hinge connection, and such that a lateral force on the member forces it against a contact surface on the closure, which in turn forces the top and bottom portions of the closure apart, thereby disengaging the stopper from the orifice.

Dispensing caps in accordance with this invention further improve upon the existing economy and benefits of resilient plastic hinged dispensing caps, by enabling one to disengage, swing open and reengage the cap closure with pressure from a single thumb or finger. This in turn permits one hand operation, which provides more sanitary operation as well as a higher degree of convenience and efficiency to the user.

Further advantages of dispensing caps in accordance with the invention include improvements in manufacturing economy, ease of stacking, and the maintenance of closure integrity during packaging, shipping, marketing and storage. The construction lends itself to manufacture by injection molding, and the operating member may be molded separately or integrally with the top and base portions of the cap. Materials and manufacturing processes known in the art may be used. Resilient plastics such as, for example, polypropylene, polyethylene and copolymers thereof, may be used. Screw threads or other known means may be used to secure the cap base to the dispensing container.

Further objects and advantages of the invention will become apparent from the attached drawings and the description which follows.

BRIEF DESCRIPTION OF THE DRAWINGS

FIG. 1 is a cross-sectional view of a one-piece cap containing a closure cover attached to the base of the cap through a flexible hinge. FIG. 2 depicts a cap similar to that of FIG. 1, differing by the incorporation of a bi-stable hinge. FIG. 3 is a two-piece cap with the closure cover and base connected by interlocking hinge components, and with indentations on the cover and base on the side opposite the hinge to facilitate opening.

DESCRIPTION OF THE PREFERRED EMBODIMENTS

Figure 1:
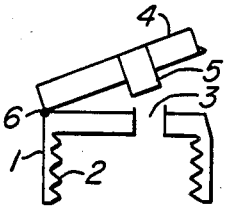
FIG. 1. PRIOR ART
FIGS. 1, 2 and 3 are representations of the prior art.
Figure 2:
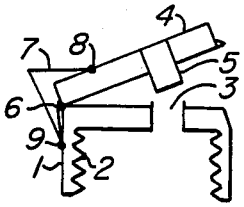
FIG. 2. PRIOR ART
Figure 3:
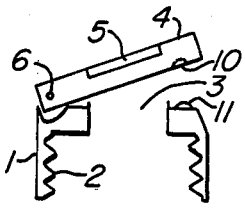
FIG. 3. PRIOR ART

Three basic prior art structures are shown in FIGS. 1, 2, and 3. These structures each include a base portion 1 with screw threads 2 and a dispensing outlet in the form of an axial orifice 3. The base 1 is joined to a top portion 4 through a hinge connection 6. A stopper 5 in the top portion 4 mates with the orifice 3. The hinge connection in FIG. 2 is a bi-stable hinge connection 7 joined to the top portion and base, respectively, at flexible pivot joints 8, 9. In FIG. 3, complementary surface contours 10, 11 on the base portion 1 and top portion 4, respectively, join together to ensure proper closure.

FIGS. 4 through 17 show improvements on the structures of FIGS. 1, 2, and 3, in accordance with various embodiments of the present invention. These improvements may be attached to or integrated into the cap structures of FIGS. 1, 2, and 3. The improvements generally involve an operating member 13 one end of which is exposed 12 for engagement by a finger or thumb. Disengagement of the stopper 5 from the orifice 3 is accomplished by pushing with one's thumb or finger on the exposed end of the operating member in the direction inward toward the center of the cap.

In FIGS. 4, 5, 7, 8, 9, 10, 11, and 12, the operating member 13 is joined through an intermediate pivot joint 14 to a secondary arm which is joined to the top portion of the cap through a pivot joint 15. When finger pressure is applied to the exposed end 12 of the operating member 13, the underside of the intermediate pivot joint 14 contacts and presses against the base portion 1 of the cap at a contact surface 16. The pressure of the operating arm 13 on the contact surface 16 causes disengagement of the stopper 5 from the orifice 3 in a snap action.

The same thumb or finger then pulls outward and downward on the exposed end 12 of the operating member to flip the top portion 4 up, rotating it to its fully open position. Then, to close the cap, the same thumb or finger pushes inward and upward on the exposed end 12, flipping the top portion 4 back into position over the base 1, reengaging the stopper 5 and orifice 3. In an alternative arrangement (not shown), the operating member 13 may extend beyond and underneath the pivot joint 14, and the extending portion would press against the contact surface 16 to force the cap open.

Figure 4:
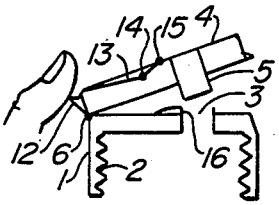
FIG. 4 is a depiction of one embodiment of the present invention, in the form of a modification of the structure shown in FIG. 1.
Figure 5:
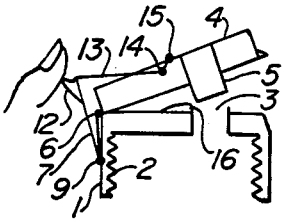
FIG. 5 is a depiction of another embodiment of the present invention, in the form of a modification of the structure shown in FIG. 2.

The embodiment of FIG. 5 is similar to that of FIG. 4, except for the incorporation of a bi-stable hinge similar to that of FIG. 2. In FIG. 5, the operating member 13 forms the upper arm portion 7 of the bi-stable hinge. The flexible pivot joint 14 of FIG. 5 corresponds to the flexible pivot joint 8 of FIG. 2. The structure which embodies the present invention is achieved by modifying the upper arm of the bi-stable hinge 7 of FIG. 2 to add the intermediate pivot joint 14, producing a combination operating member mechanism 13, 14, 15 and bi-stable hinge connection 7, 14, 9.

Figure 6:
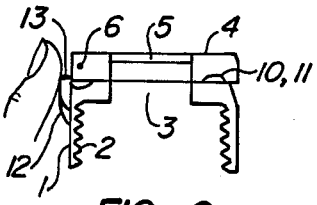
FIG. 6 is a depiction of still another embodiment of the present invention, in the form of a modification of the structure shown in FIG. 3.

FIG. 6 depicts an embodiment of the invention adapted for use in connection with the structure shown in FIG. 3. The mechanism in FIG. 6 is operated by inward pressure on the exposed end 12 of the operating member 13 toward the center of the cap. The pressure is transmitted to the skirt of the top portion 4 of the cap at a point below the pivot axis 6 of the cap. This causes the stopper 5 to become disengaged from the orifice 3 with a snap action, and the top portion 4 to simultaneously rise and rotate to the open position. To close the cap, the user applies thumb or finger pressure on the upper surface of the top portion 4, reengaging the stopper 5 and orifice 3.

Figure 7:
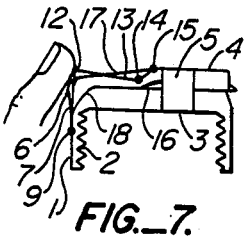
FIG. 7 is a depiction of a still further embodiment of the invention, again in cross section.
Figure 8:
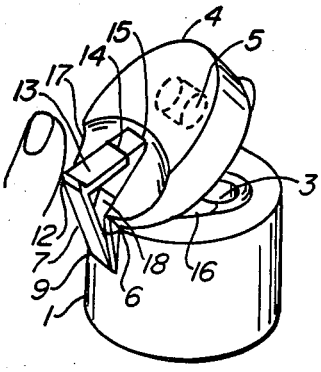
FIG. 8 is a perspective view of the hinge area of the embodiment of FIG. 7.
Figure 9:
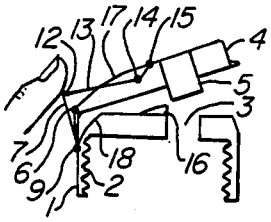
FIG. 9 is a view of the embodiment of FIG. 7 with the cap in the open position.

FIGS. 7 through 9 show a variation on the embodiment of FIG. 5, incorporating a beveled surface 17 on the top portion and a further beveled surface 18 on the base, both beneath the exposed end 12 of the operating member 13. These beveled surfaces allow the thumb or finger to more effectively operate the exposed end 12, permitting the latter to be shaped so that it lies within the periphery of the cap rather than outside it as in FIGS. 4 and 5. These beveled surfaces also permit placement of the exposed end 12 at the corner of the operating member 13 rather than on its side, again as shown in FIGS. 4 and 5. This type of arrangement can provide in a substantially symmetrical surface contour for the cap, lending itself well to manufacturing, design and overall convenience.

FIG. 8 shows the structure of FIGS. 7 and 9 in perspective, demonstrating how the lateral external surface of the top portion 4 of the cap and the exposed end 12 of the operating member are flush, so that the exposed end does not protrude laterally when the cap is closed.

Figure 10:
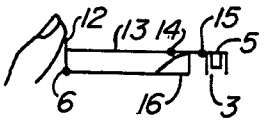
FIG. 10 is a cross sectional side view of an operating member in accordance with one embodiment of the invention, with the closure engaged.
Figure 11:
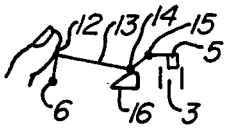
FIG. 11 is a view of the embodiment of FIG. 10 with the closure disengaged.

The operating mechanism of the embodiment shown in FIGS. 7 through 9 is shown in FIGS. 10 and 11. FIG. 10 shows the mechanism in the relaxed position, with the stopper 5 and orifice 3 engaged. FIG. 11 shows the joint in the flexed position with the stopper 5 and orifice 3 disengaged, after a thumb or finger has applied pressure to the exposed end 12. FIGS. 10 and 11 also show how the inclined contact surface 16 can be added to the top of the base portion 1 of the cap to serve as part of the operating mechanism, this being the surface contacted by the underside of the intermediate pivot joint 14 during flexure of the operating member 13 and the two pivot joints 14, 15.

Figure 12:
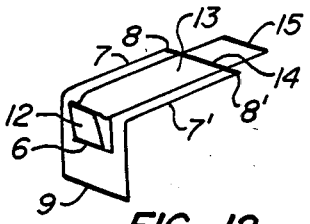
FIG. 12 is a perspective view of the embodiment shown in FIGS. 10 and 11, showing the operating member as part of a bi-stable hinge.

FIG. 12 shows the operating mechanism 13, 14, 15, nested inside a bi-stable hinge connection 7, 8, 9. This is an alternative to the embodiment of FIGS. 5, 7, 8, and 9, where the operating mechanism is combined with the bi-stable hinge. The structure of FIG. 12 preserves the complete working of the bi-stable hinge connection.

Figure 13:
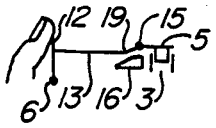
FIG. 13 is a cross sectional side view of a variation on the embodiment of FIGS. 10 and 11, with the operating member modified to have a curved portion.
Figure 14:
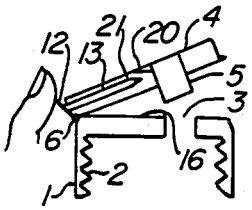
FIG. 14 is a cross sectional side view of yet another embodiment of the invention, in which the operating member terminates in a wedge.

In FIG. 13, the intermediate pivot joint 14 of the operating mechanism is replaced by a flexible curved region 19. When pressure is applied to the exposed end 12 of the operating member 13, the curved region 29 presses against the base portion 1. Again, the inclined contact surface 16 may be added to the top of the base portion 1 to assist in the transmission of the force.

FIGS. 14 through 17 show an alternative embodiment of the operating member 13. Here the operating member is in the form of a tongue whose wedge-shaped terminus 21 is pushed or pulled between complementary surfaces on the top portion 4 and base 1, spreading these surfaces apart to disengage the stopper 5 from the orifice 3. Inclined surfaces may be affixed to these complementary surfaces as well. An inclined surface 20 on the top portion and an inclined surface 16 on the base portion would coact with the operating member 13 at its wedge-shaped terminus 21 to assist in spreading the top and base portions apart and disengaging the stopper 5 from the orifice 3.

Figure 15:
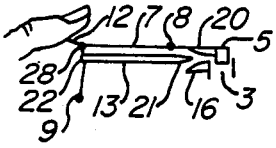
FIG. 15 is a cross sectional side view of an embodiment similar to that of FIG. 14 except for a bi-stable hinge.

In the embodiment shown in FIG. 15, flexible pivot joints 22 and 23 are added, forming a flexible joint combination 9, 22, 23. When downward pressure is applied to the exposed end 12, the flexible joint combination 9, 22, 23 thrusts the operating member 13 forward.

Figure 16:
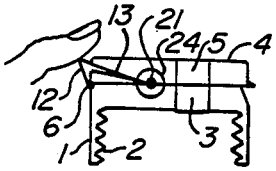
FIG. 16 is a cross sectional side view of yet another embodiment of the invention, in which the operating member terminates in a spherical portion functioning as a wedge.

In the embodiment shown in FIG. 16, the operating member 13 terminates in a spherical tip 21. This spherical tip is received in a two-part cavity 24, which is formed between the base 1 and the top portion 4 when the stopper 5 and orifice 3 are engaged. The cavity 24 is complementary to the spherical tip 21, and coacts with it to assist in spreading apart the top portion 4 and the base 1, again causing disengagement of the stopper 5 from the orifice 3.

Figure 17:
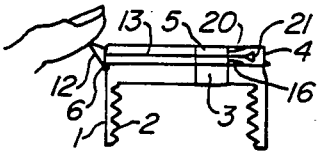
FIG. 17 is a cross sectional side view of yet another embodiment of the invention, in which the operating member encircles the closure and functions as a wedge.

In the embodiment shown in FIG. 17, the operating member is in the form of a yoke which encircles the stopper 5 and orifice 3, and has a wedge-shaped terminus 21. The latter spreads apart the top portion 4 and the base 1 by pressing against the inclined surface 16 on the base and an inclined surface 20 on the top portion. This causes the stopper 5 and orifice 3 to disengage when downward and outward pressure is applied by a thumb or finger on the exposed end 12 in the direction away from the center of the cap.

The screw threads 2 shown in each of these embodiments are one example of means to secure the base portion 1 of the cap to the container. Other means well known to those skilled in the art will serve equally well.

OPERATION

For each of the embodiments shown above, the user holds the receptacle in one hand, and with the thumb or a finger of that hand operates the disengagement, swinging open, and closing of the upper portion on the dispensing cap.

The stopper 5 and orifice 3 are disengaged by either pulling or pushing on the exposed end 12 of the operating member 13 with a thumb or finger. The resulting pressure is transmitted to a cam-like or wedge-like action between the top portion 4 of the cap and its base 1, disengaging the stopper from the orifice.

With the stopper and orifice disengaged, the upper portion 4 of the cap then rotates upward away from the base 1 when the thumb or finger pulls downward on the exposed end and outward from the cap base 1.

To reclose the cap, the top portion 4 is pivoted back downward toward the base by the thumb or finger pressing upward and inward on the exposed end 12. The pivoting momentum of the top portion during this action causes the stopper 5 and orifice 3 to snap together and close.

We claim:

1. A dispensing cap comprising:

a closure comprising (a) a base portion containing an orifice, and (b) a top portion mounted to said base portion by a hinge connection at one side thereof and containing a stopper to mate with said orifice, said closure defining a longitudinal axis of said dispensing cap;

an operating member mounted to said closure, having an exposed end at the same side of said closure as said hinge connection, said operating member being movable upon exertion of an externally applied force on said exposed end directed laterally with respect to said longitudinal axis to abut a contact surface on said closure and thereupon exert a contact force on said contact surface; and means for transmitting said contact force to said top and bottom portions in opposing directions to disengage said stopper from said orifice.

2. A dispensing cap in accordance with claim 1 in which said operating member is adapted to so move when said externally applied force is directed toward said longitudinal axis.

3. A dispensing cap in accordance with claim 1 in which said operating member is adapted to so move when said externally applied force is directed away from said longitudinal axis.

4. A dispensing cap in accordance with claim 1 in which said exposed end protrudes from said closure.

5. A dispensing cap in accordance with claim 1 further comprising a finger grip on said top portion at the same side of said closure as said hinge connection for manually separating said top and bottom portions once said stopper is disengaged from said orifice.

6. A dispensing cap in accordance with claim 5 in which said finger grip is a tab protruding from said exposed end.

7. A dispensing cap in accordance with claim 5 in which said finger grip is said exposed end.

8. A dispensing cap in accordance with claim 1 in which said top portion has a lateral external surface and said exposed end is flush with said lateral external surface.

9. A dispensing cap in accordance with claim 1 in which said hinge connection is a bi-stable hinge.

10. A dispensing cap in accordance with claim 1 in which said hinge connection is a bi-stable hinge, and said dispensing cap further comprises a finger grip on said bistable hinge for manually separating said top and bottom portions once said stopper is disengaged from said orifice.

11. A dispensing cap in accordance with claim 1 in which said hinge connection is a bi-stable hinge and said operating member is a portion of said bistable hinge.

12. A dispensing cap in accordance with claim 1 in which said operating member contains at least one pivot joint.

13. A dispensing cap in accordance with claim 1 in which said operating member contains a flexible curved portion to abut said contact surface.

14. A dispensing cap in accordance with claim 1 in which said hinge connection pivots at a pivot axis and said contact surface is a lateral external surface region of said top portion below said pivot axis.

15. A dispensing cap in accordance with claim 1 in which said operating member has a wedged-shaped end opposing said exposed end.

16. A dispensing cap in accordance with claim 15 in which said operating member encircles said closure.

17. A dispensing cap in accordance with claim 1 in which said operating member is adapted to so move when said externally applied force is directed away from said longitudinal axis, and said operating member encircles said closure.

18. A dispensing cap in accordance with claim 1 in which said contact surface is a surface region of said base portion angled with respect thereto.

19. A dispensing cap in accordance with claim 1 in which said contact surface is a surface region of said top portion angled with respect thereto.

20. A dispensing cap in accordance with claim 1 in which said contact surface is a first surface region on said base portion, and said transmitting means comprises a second surface region in said top portion opposing said first surface region and angled with respect thereto, whereby said operating member wedges said first and second surface regions apart in response to said inwardly directed force.

21. A dispensing cap in accordance with claim 1 in which said base portion is beveled at a region adjacent to said exposed end of said operating member.

22. A dispensing cap in accordance with claim 1 in which said top portion is beveled at a region adjacent to said exposed end of said operating member.

23. A dispensing cap in accordance with claim 1 in which said base portion and said top portion are each beveled at regions adjacent to said exposed end of said operating member.

24. A dispensing cap in accordance with claim 1 in which said base portion and said top portion when closed define a cavity to receive said operating member.

* * * * *